US011363861B2

(12) United States Patent
Shaffer et al.

(10) Patent No.: US 11,363,861 B2
(45) **Date of Patent: *Jun. 21, 2022**

(54) WATCHBANDS WITH HOOK AND LOOP FASTENERS

(71) Applicant: Apple Inc., Cupertino, CA (US)

(72) Inventors: Benjamin A. Shaffer, San Jose, CA (US); Yoji Hamada, Wakayama (JP); Motohide Hatanaka, Menlo Park, CA (US); Hsiang-Hung Chen, Shenzhen (CN); Eiryo Shiraishi, Tokyo-ku (JP)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/933,854

(22) Filed: Jul. 20, 2020

(65) Prior Publication Data

US 2020/0359754 A1 Nov. 19, 2020

Related U.S. Application Data

(63) Continuation of application No. 15/663,654, filed on Jul. 28, 2017, now Pat. No. 10,750,831.

(51) Int. Cl.
*A44C 5/00* (2006.01)
*A44C 5/20* (2006.01)
(Continued)

(52) U.S. Cl.
CPC ..... *A44C 5/2071* (2013.01); *A44C 5/0053* (2013.01); *A44C 5/14* (2013.01); *G04B 37/1486* (2013.01); *A44D 2205/00* (2013.01)

(58) Field of Classification Search
CPC ..... A44C 5/2071; A44C 5/0053; A44C 5/14; G04B 37/1486; A44D 2205/00
(Continued)

(56) References Cited

U.S. PATENT DOCUMENTS 2,717,437 A * 9/1955 De Mestral ..... D03D 27/00 428/92
3,426,363 A 2/1969 Girard
(Continued)

FOREIGN PATENT DOCUMENTS

CN 201352989 12/2009
GB 1270604 4/1972
(Continued)

OTHER PUBLICATIONS

Japanese Office Action from 2020-503994, dated Apr. 19, 2021, 8 pages including English language translation.
(Continued)

*Primary Examiner* — Peter N Helvey
(74) *Attorney, Agent, or Firm* — BakerHostetler

(57) ABSTRACT

A watchband can comfortably secure an electronic device to a wrist of a user. The watchband can include a base having a contact surface opposite an engagement surface, contact loops on the contact surface for contacting a user, and engagement loops on the engagement surface for engaging hooks. The hooks can be provided on the engagement surface, opposite some of the contact loops. The base can include base threads, and the contact loops and engagement loops can be formed by contact threads and engagement threads woven about some of the base threads between the contact surface and the engagement surface. Between adjacent engagement loops, the engagement thread can be more securely attached to the base than is the contact thread between adjacent contact loops.

20 Claims, 16 Drawing Sheets

(51) Int. Cl.
*A44C 5/14* (2006.01)
*G04B 37/14* (2006.01)

(58) Field of Classification Search
USPC ..... 368/282
See application file for complete search history.

(56) References Cited

U.S. PATENT DOCUMENTS

| | | | | |
|---|---|---|---|---|
| 3,594,873 | A * | 7/1971 | Hockmeyer, Jr. .. | A44B 18/0034 24/445 |
| 5,332,135 | A | 7/1994 | Fletcher | |
| 5,369,853 | A * | 12/1994 | Okawa ..... | A44B 18/003 24/446 |
| 5,659,930 | A * | 8/1997 | Okawa ..... | A44B 18/0023 24/445 |
| 5,686,163 | A * | 11/1997 | Tsubata ..... | A44B 18/0034 428/99 |
| 5,762,241 | A | 6/1998 | Cross | |
| 5,769,290 | A | 6/1998 | Pestana | |
| 5,996,189 | A * | 12/1999 | Wang ..... | A44B 18/0023 24/442 |
| 6,179,177 | B1 | 1/2001 | Hihara | |
| 6,199,730 | B1 | 3/2001 | Chisolm | |
| 6,276,580 | B1 | 8/2001 | Kitahara | |
| 6,443,187 | B1 | 9/2002 | Wang et al. | |
| 6,921,006 | B2 * | 7/2005 | Bauer ..... | A44C 5/16 224/164 |
| 7,070,322 | B1 | 7/2006 | Field | |
| 7,305,718 | B2 | 12/2007 | Avilone | |
| 8,919,019 | B2 | 12/2014 | Martinez | |
| 9,700,105 | B2 * | 7/2017 | Kaikou ..... | A44B 18/003 |
| 10,638,817 | B2 * | 5/2020 | Kaiko ..... | A44B 18/0023 |
| 10,750,831 | B2 * | 8/2020 | Shaffer ..... | A44C 5/14 |
| 2005/0236445 | A1 | 10/2005 | Nix | |
| 2011/0266314 | A1 | 11/2011 | Sommers | |
| 2014/0084033 | A1 | 3/2014 | Kellond | |
| 2016/0058164 | A1 | 3/2016 | Rohrbach | |
| 2016/0249712 | A1 | 9/2016 | Pluemer | |

FOREIGN PATENT DOCUMENTS

| | | |
|---|---|---|
| JP | H 08-070914 | 3/1996 |
| JP | H 09-168413 | 6/1997 |
| JP | 2003-515409 | 5/2003 |
| JP | 3138857 U | 1/2008 |
| WO | WO 01/41596 | 6/2001 |

OTHER PUBLICATIONS

International Search Report and Written Opinion from PCT/US2018/041652, dated Sep. 26, 2018, 15 pages.
Japanese Office Action from 2020-503994, dated Dec. 17, 2021, 5 pages including machine-generated English language translation.
Great Britain Office Action from Great Britain Patent Application No. 2200196.0, dated Mar. 25, 2022, 5 pages.

* cited by examiner

WATCHBANDS WITH HOOK AND LOOP FASTENERS

CROSS-REFERENCE TO RELATED APPLICATIONS

This application is a continuation of U.S. application Ser. No. 15/663,654, filed on Jul. 28, 2017, entitled "WATCHBANDS WITH HOOK AND LOOP FASTENERS," the disclosure of which is hereby incorporated herein in its entirety.

TECHNICAL FIELD

The present description relates generally to securement of wearable devices, and, more particularly, to watchbands with hook and loop fasteners.

BACKGROUND

Some electronic devices may be removably attached to a user. For example, a wristwatch or fitness/health tracking device can be attached to a user's wrist by joining free ends of a watchband together. In many cases, watchbands may have limited fit adjustment increments available. For example, some bands have an incrementally user-adjustable size (e.g., a buckling clasp, pin and eyelet, etc.) whereas other bands have a substantially fixed size, adjustable only with specialized tools and/or expertise (e.g., folding clasp, deployment clasp, snap-fit clasp, etc.). Other bands may be elasticated expansion-type bands that stretch to fit around a user's wrist. The degree of comfort and securement of the electronic device can depend on the function and arrangement of the watchband.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
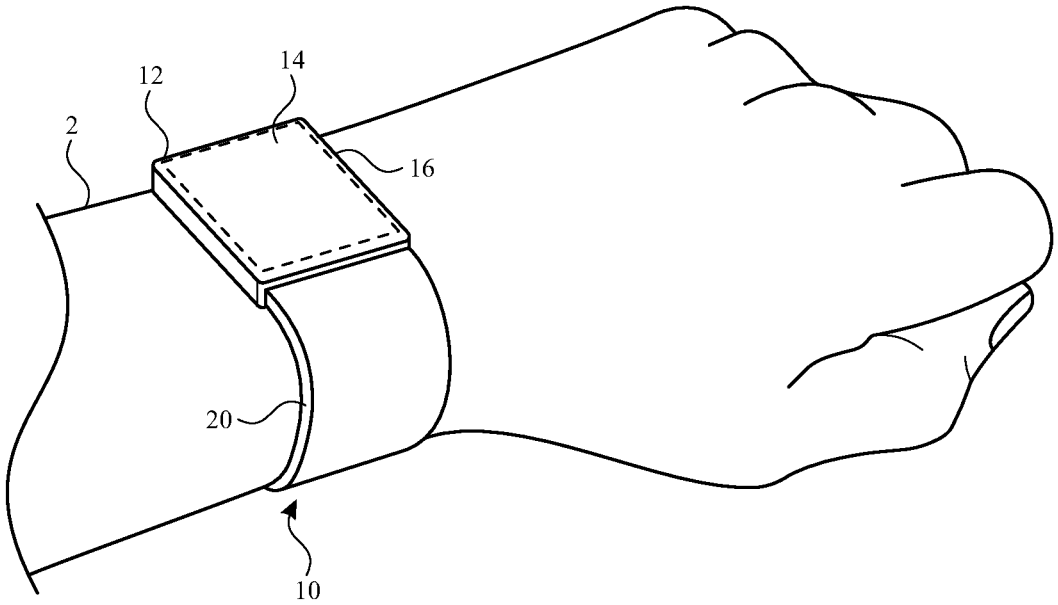
FIG. 1 is a perspective view of a watch on a wrist of a user, in accordance with some embodiments of the present disclosure.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

An electronic device, such as a wristwatch or fitness/health tracking device, can be attached to a user's wrist by a watchband. It can be desirable to maintain a secure attachment to the wrist so that the electronic device does not shift excessively or slip off of the user. Securement of the electronic device against the user can also be important to the function of electronic components, such as biometric sensors. Additionally, it can be desirable to maximize the comfort of the user while wearing the electronic device. Often, a secure attachment can apply an undesirable amount of force on the wrist of the user. In many cases, conventional watchbands may catch, pinch, or pull a user's hair or skin during use if the band is overly tight. In other cases, watchbands may slide along a user's wrist, turn about a user's wrist, or may be otherwise uncomfortable or bothersome to a user if the band is overly loose. These problems can be exacerbated during periods of heightened activity, such as while running or playing sports.

Furthermore, adjusting the size or fit of conventional watchbands often requires multiple steps, specialized tools, and/or technical expertise. Sizing options available to a user may be insufficient to obtain a proper fit. The fit may be different and/or may be perceived to be different given certain environmental (e.g. temperature, humidity) or biological conditions (e.g., sweat, inflammation). As a result, users of conventional wristwatches and/or fitness/health tracking devices may select a tolerable (although not optimally comfortable) fit, reserving tight bands for fitness/health tracking devices and loose bands for conventional wristwatches. However, some wearable electronic devices may be multi-purpose devices, providing both fitness/health tracking and timekeeping functionality. Accordingly, a user may prefer the fit of a watch to vary with use. For example, a user may prefer a looser fit in a timekeeping mode and a tighter fit in a fitness/health tracking mode. Accordingly, there may be a present need for systems and methods for dynamic adjustment of the fit of wearable electronic devices.

Embodiments of the present disclosure provide hook and loop attachment mechanisms. The attachment mechanisms provide secure attachment to a user and also provide enhanced comfort. For example, loops can be woven in a pattern to provide engagement with hooks as well as comfortable contact with the user. The loops can be woven in a manner that forms the loops on a contact side of the watchband for contacting the skin of the user and providing moisture wicking or air ventilation. Embodiments of the present disclosure provide ease of adjustment by a user as well as secure attachment to avoid inadvertent release under external forces.

Figure 2:
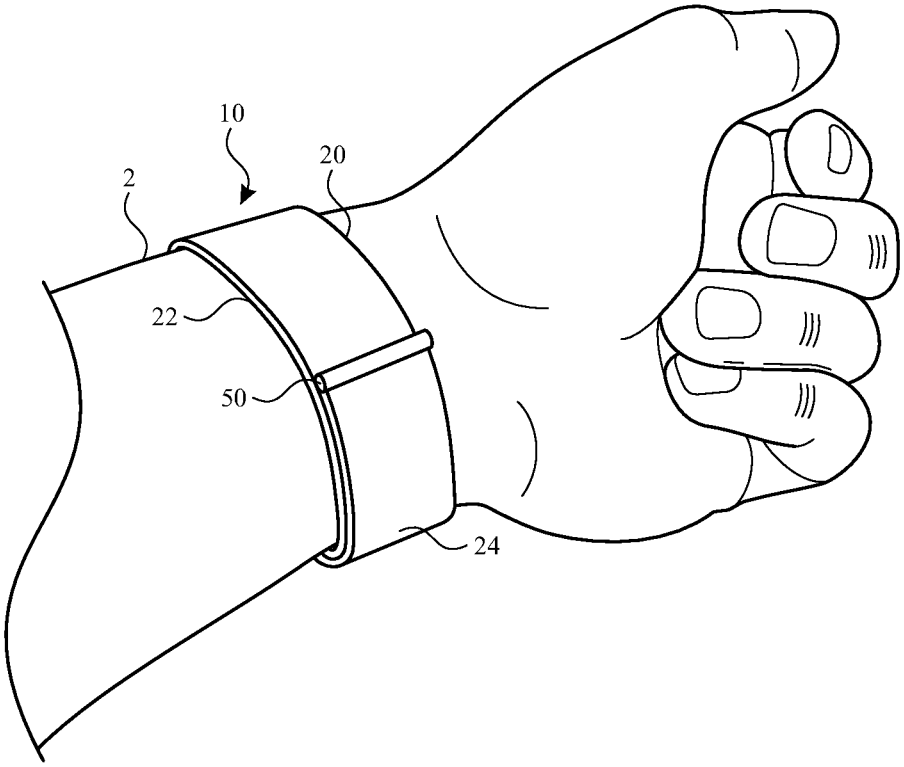
FIG. 2 is another perspective view of the watch of FIG. 1 on the wrist of the user, in accordance with some embodiments of the present disclosure.

According to some embodiments, for example as shown in FIG. 1, a watch 10 includes an electronic device 12 that is worn on a wrist 2 with a watchband 20. The electronic device 12 can be portable and also attached to other body parts of the user or to other devices, structures, or objects. The watchband 20 can be flexible and encircle at least a portion of the wrist 2 of a user. By securing the electronic device 12 to the person of the user, the watchband 20 provides security and convenience. In some embodiments, the electronic device 12 includes a display 14 and a housing 16 for containing components. According to some embodiments, for example as shown in FIG. 2, the watchband 20 extends to an opposite side of the wrist 2 of user from electronic device 12. The watchband 20 includes an inner portion 22 and an outer portion 24 that overlap and engage each other.

Figure 3:
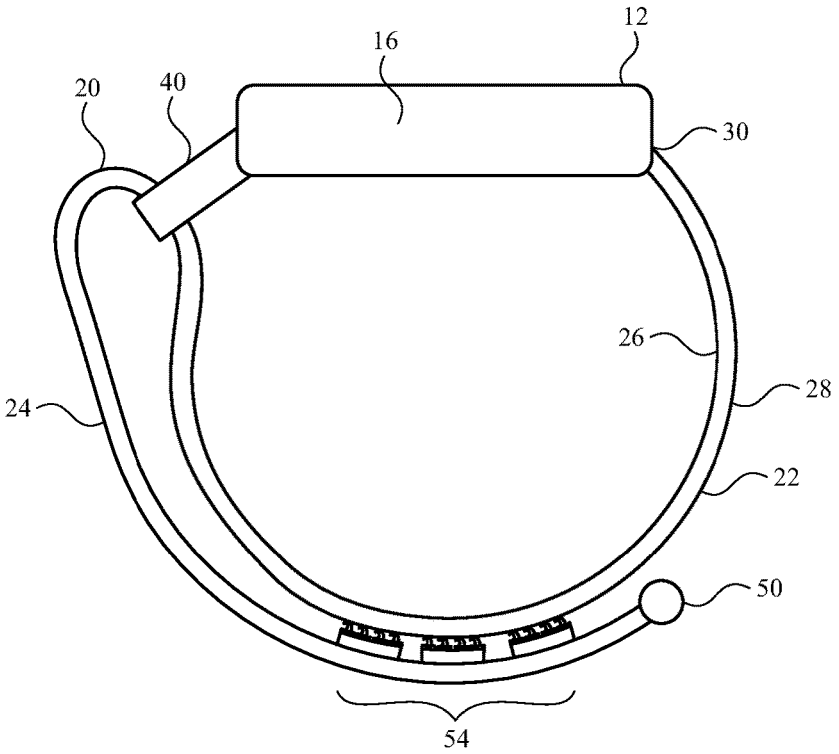
FIG. 3 is a side view of a watch with a watchband, in accordance with some embodiments of the present disclosure.

According to some embodiments, for example as shown in FIG. 3, the watchband 20 is adjustable to fit securely and comfortably onto the wrist 2 by selecting an extent of overlap between the inner portion 22 and the outer portion 24. For example, the diameter of the watchband 20 is adjustable to be appropriate for a secure and comfortable fit on the wrist 2. The watchband 20 removably attaches to a portion of the housing 16 of the electronic device 12 with a housing connector 30. The watchband 20 removably attaches to another portion of the housing 16 of the electronic device 12 with a retaining ring 40. Accordingly, the watchband is removeable from the electronic device 12 and replaced, thereby permitting a user to switch watchbands as necessary or desired. A portion of the watchband 20 passes through a hole of the retaining ring 40, such that the length of the inner portion 22 and the length of the outer portion 24 are defined on either side of the retaining ring 40.

A contact surface 26 of the watchband 20 is positionable to contact the wrist 2 of the user. Along the inner portion 22, the contact surface 26 faces inwardly toward the wrist 2. Along the outer portion 24, the contact surface 26 continues as an outwardly facing surface. An engagement surface 28 of the watchband 20 is positionable to contact itself. Along the inner portion 22, the engagement surface 28 faces outwardly away from the wrist 2. Along the outer portion 24, the engagement surface 28 faces inwardly toward the inner portion 22 and opposite the portion of the engagement surface 28 that extends along the inner portion 22. A hook zone 54 is provided on the engagement surface 28 and along the outer portion 24. The hook zone 54 is arranged to engage loops of a loop zone 52 on the engagement surface 28 and along the inner portion 22, as described further herein. The engagement surface 28 can be arranged to avoid contact with the wrist 2 of the user.

Figure 4:
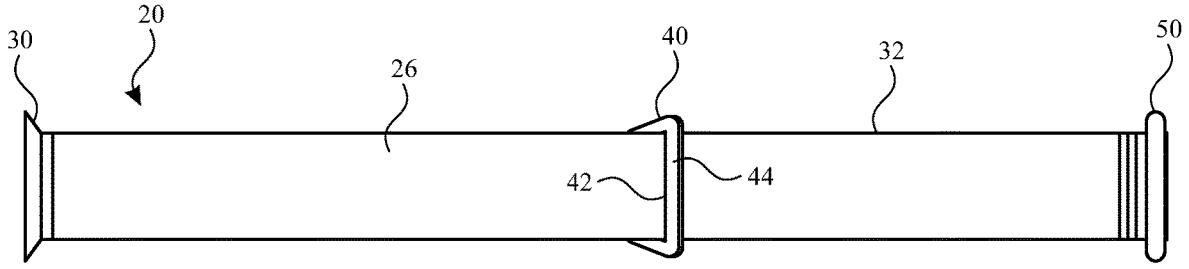
FIG. 4 is a top view of a watchband, in accordance with some embodiments of the present disclosure.

According to some embodiments, for example as shown in FIG. 4, the housing connector 30 and a stopper 50 are located at or near ends of the watchband 20. The retaining ring 40 is slidably connected to a base 32 of the watchband 20 and provides a connection to the housing 16 of the electronic device 12. The contact surface 26 extends between the housing connector 30 and the stopper 50. For example, the contact surface 26 extends to the housing connector 30 and/or the stopper 50. The contact surface 26 provides loops extending from the base 32 for contacting the wrist 2 along the inner portion 22 and for providing an outwardly facing surface along the outer portion 24.

As shown in FIG. 4, the retaining ring 40 can have an engagement end 44 and a hole 42 through which the watchband 20 can extend. The stopper 50 has at least one cross-sectional dimension that is larger than at least one cross-sectional dimension of the hole 42. For example, the stopper 50 can have a lateral cross-sectional dimension, transverse to a longitudinal axis of the watchband 20, that is larger than a lateral cross-sectional dimension of the hole 42. The retaining ring 40 further includes an engagement member for secure engagement with the housing 16 of the electronic device 12. For example, the engagement member allows the retaining ring 40 to securely engage the housing 16 within a channel thereof. The engagement member can be the same as, similar to, or different from an engagement member of the housing connector 30.

Figure 5:
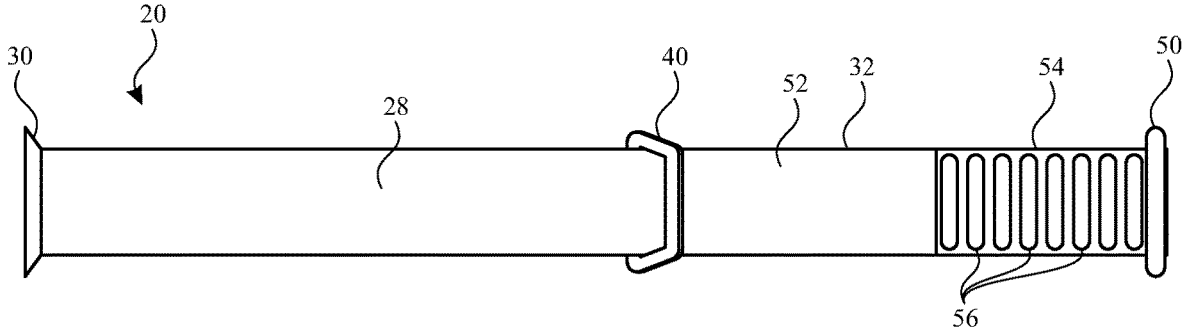
FIG. 5 is another view of the watchband of FIG. 4, in accordance with some embodiments of the present disclosure.

According to some embodiments, for example as shown in FIG. 5, the engagement surface 28 extends between the housing connector 30 and the stopper 50. The engagement surface 28 includes the loop zone 52 and the hook zone 54. The loop zone 52 can extend closer to the housing connector 30, and the hook zone 54 can extend closer to the stopper 50. Along the loop zone 52, the engagement surface 28 provides loops extending from the base 32 for engagement with hooks of the hook zone 54. The hook zone 54 can include one or more hook pads 56 attached to the base 32 and for engagement with the loops of the loop zone 52.

As shown in FIGS. 4 and 5, the portion of the contact surface 26 having loops can have a greater area than the area of the loop zone 52 of the engagement surface 28. For example, the contact surface 26 can have loops along an entire length thereof between the housing connector 30 and the stopper 50. The engagement surface 28 can be divided between the loop zone 52 and the hook zone 54.

Figure 6:
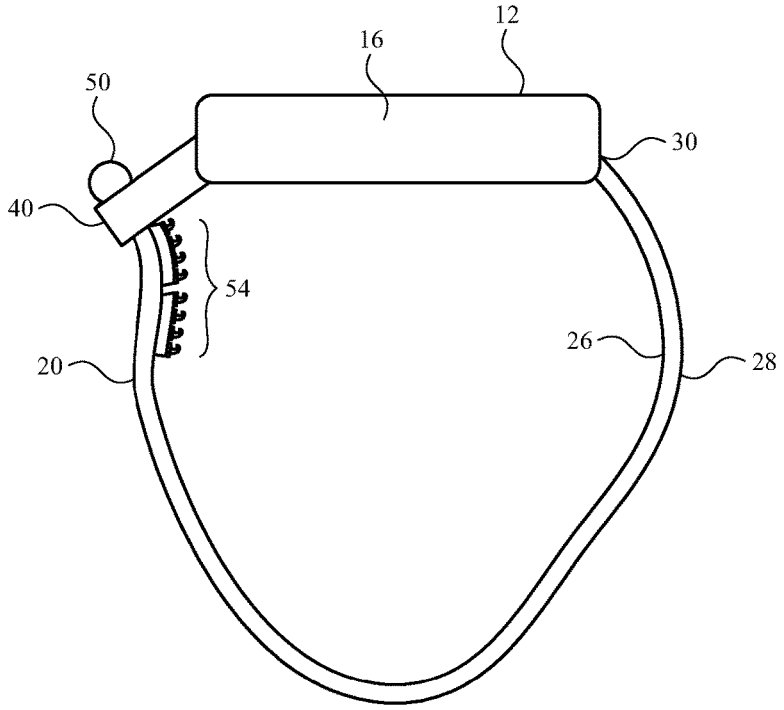
FIG. 6 is a side view of a watch with a watchband, in accordance with some embodiments of the present disclosure.

According to some embodiments, for example as shown in FIG. 6, the watchband 20 slidably extends through the retaining ring 40. The length of the watchband 20 that extends on either side of the retaining ring 40 can be adjusted as desired by a user for preferred comfort and grip on the wrist 2 of the user. A stopper 50 can be sized and arranged to prevent passage through the retaining ring 40 so that a portion of the watchband 20 remains within at least a portion of the retaining ring 40. The stopper 50 can include features on an end of the outer portion 24, along the outer portion 24, on the engagement surface 28, and/or on the contact surface 26.

Figure 7:
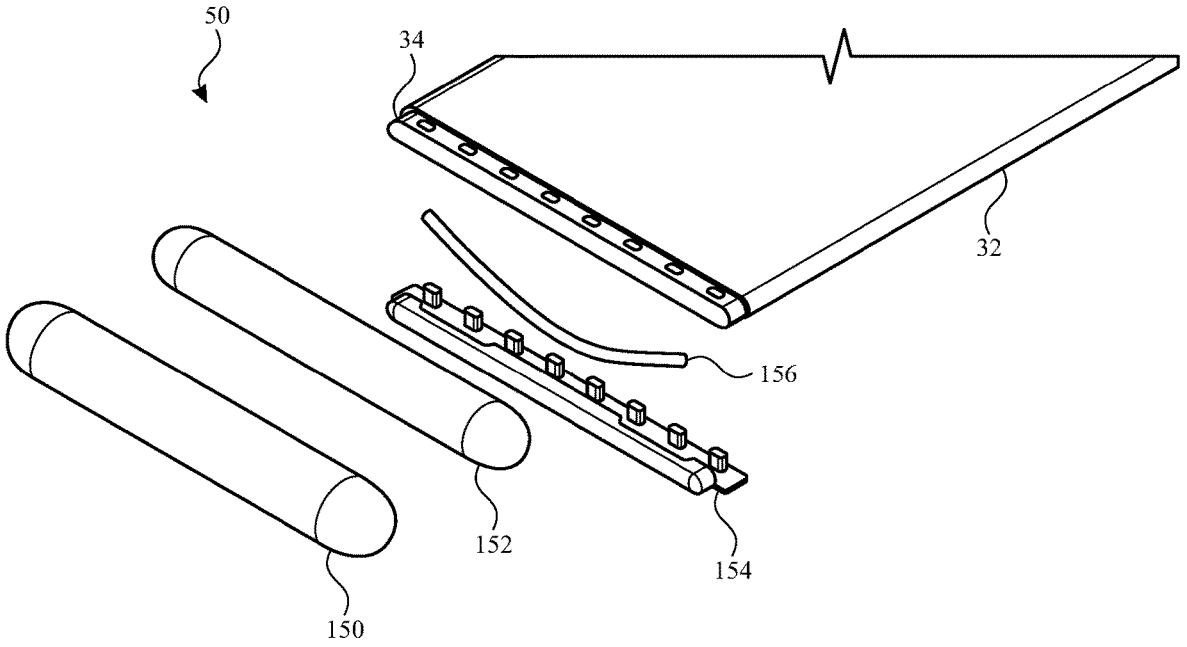
FIG. 7 is a perspective exploded view of a stopper and a base, in accordance with some embodiments of the present disclosure.
Figure 8:
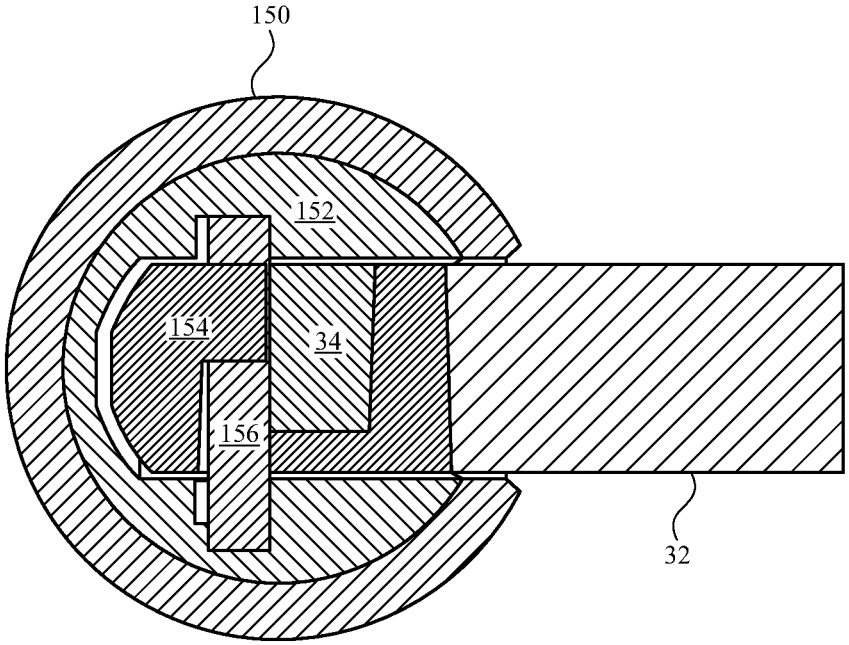
FIG. 8 is a sectional view of the stopper and the base of FIG. 7, in accordance with some embodiments of the present disclosure.

According to some embodiments, for example as shown in FIGS. 7 and 8, the stopper 50 is assembled with a spring element to securely engage the base 32 of the watchband 20. The base 32 can include an engagement section 34 with which one or more portions of a shell 154 can engage. For example, one or more teeth of the shell 154 extend into holes of the engagement section 34. A bow spring 156 is provided between the shell 154 and an insert 152. When the insert 152 is placed over the shell 154, the insert 152 prevents the shell 154 from disengaging from the engagement section 34. When the bow spring 156, within the insert 152, extends to a relaxed position, the bow spring 156 prevents the insert 152 from sliding off of the shell 154. A cover 150 can be provided (e.g., overmolded) over at least a portion of the insert 152.

Figure 9:
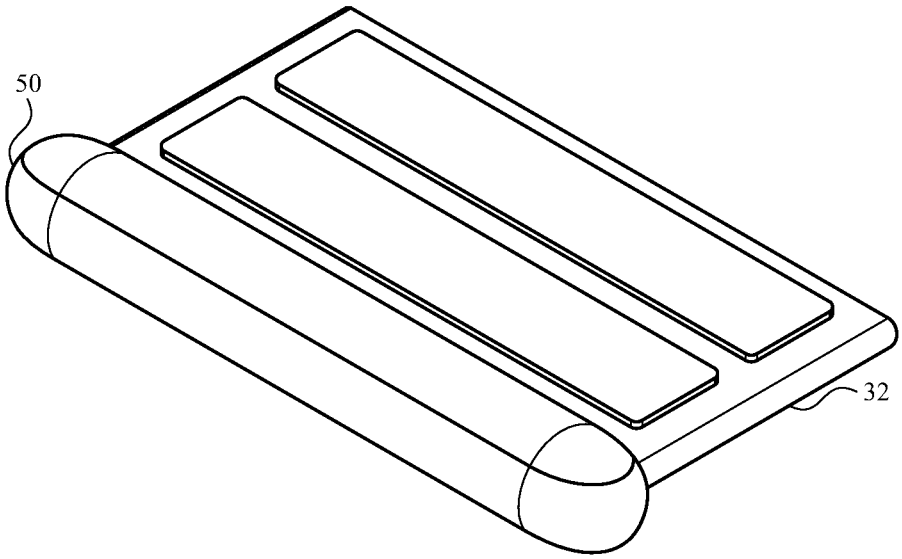
FIG. 9 is a perspective view of a stopper and a base, in accordance with some embodiments of the present disclosure.
Figure 10:
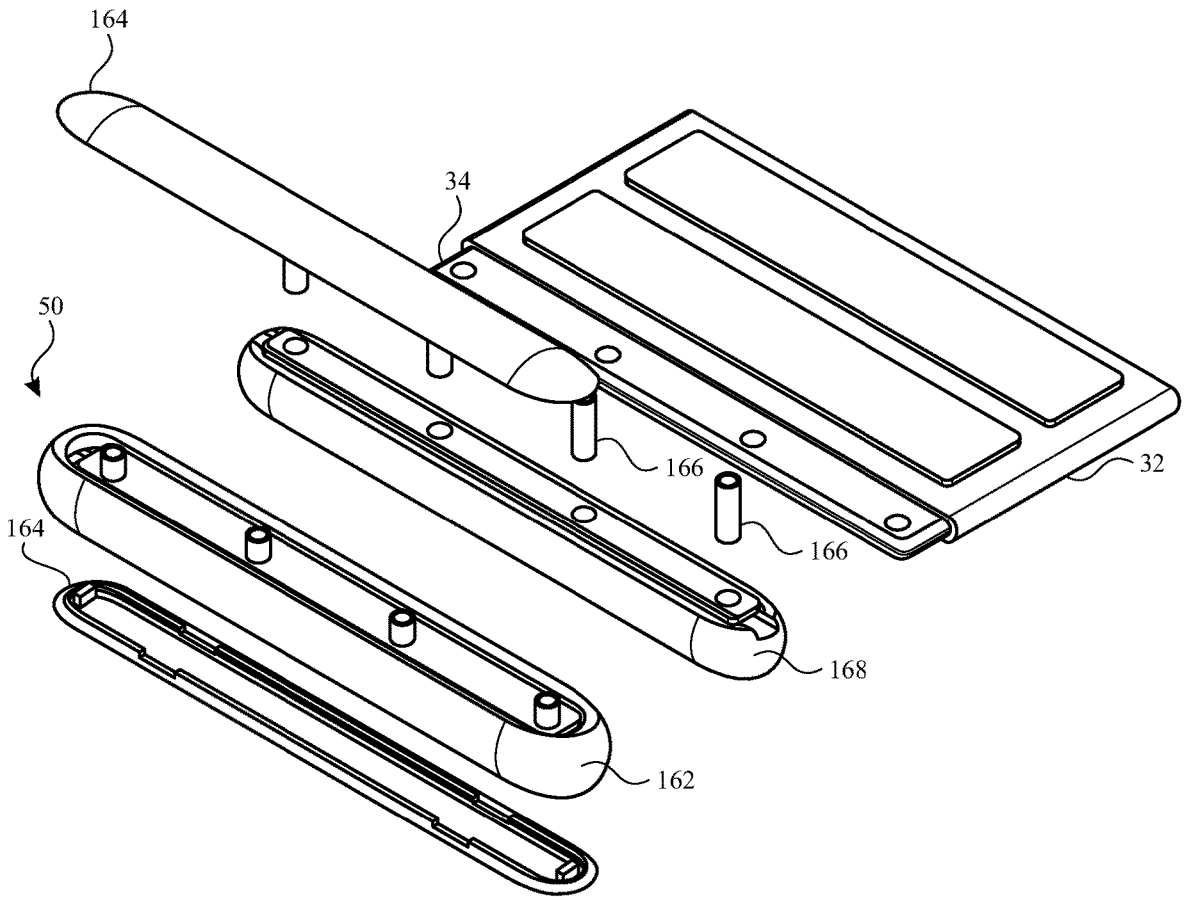
FIG. 10 is a perspective exploded view of the stopper and the base of FIG. 9, in accordance with some embodiments of the present disclosure.

According to some embodiments, for example as shown in FIGS. 9 and 10, the stopper 50 is assembled with pins to securely engage the base 32 of the watchband 20. The base 32 can include an engagement section 34 with which one or more pins 166 can engage. For example, one or more pins 166 can extend through holes of the engagement section 34, through holes of a shell 168, and/or holes of an insert 162. The shell 168 can fit within at least a portion of the insert 162. The pins 166 prevent the engagement section 34 from disengaging longitudinally away from the insert 162 and/or the shell 168. One of more covers 164 can be provided (e.g., overmolded, adhered, snapped) over at least a portion of the insert 162 and/or the shell 168 to keep the pins 166 from moving out of the insert 162 and/or the shell 168.

Figure 11:
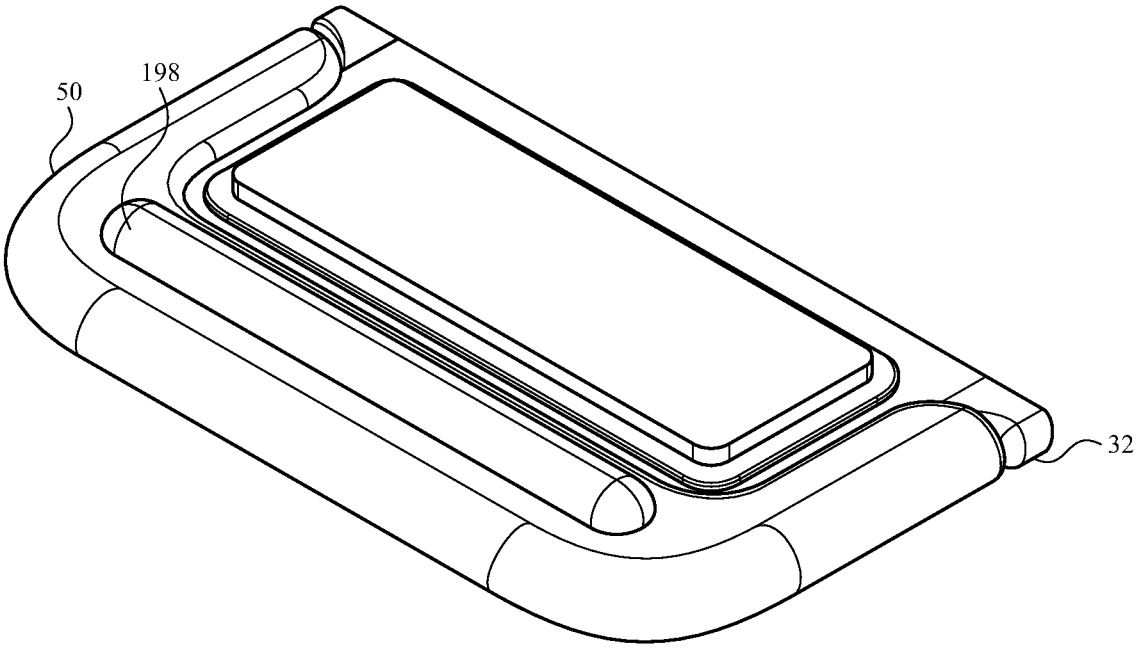
FIG. 11 is a perspective view of a stopper and a base, in accordance with some embodiments of the present disclosure.
Figure 12:
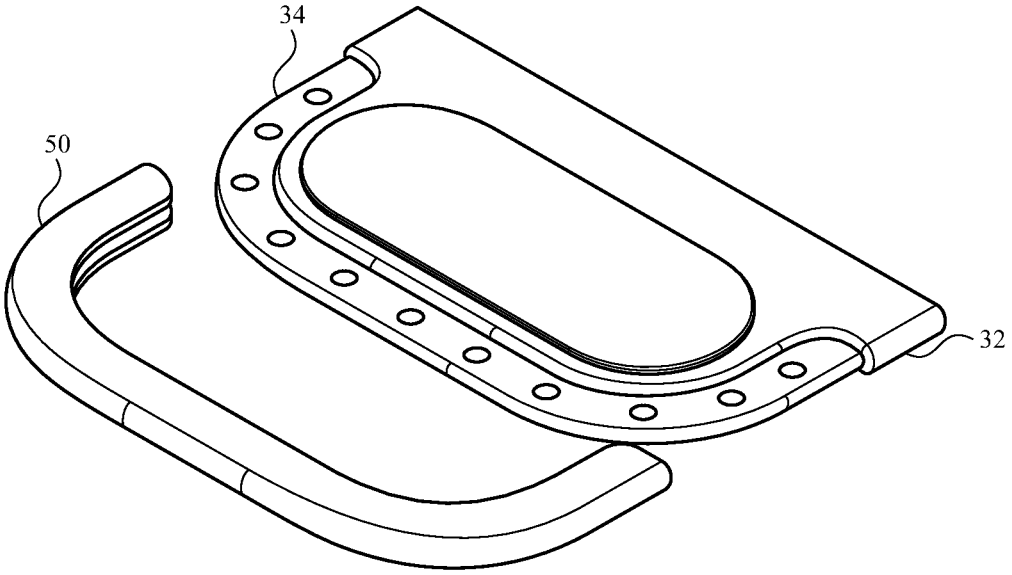
FIG. 12 is a perspective exploded view of a stopper and a base, in accordance with some embodiments of the present disclosure.
Figure 13:
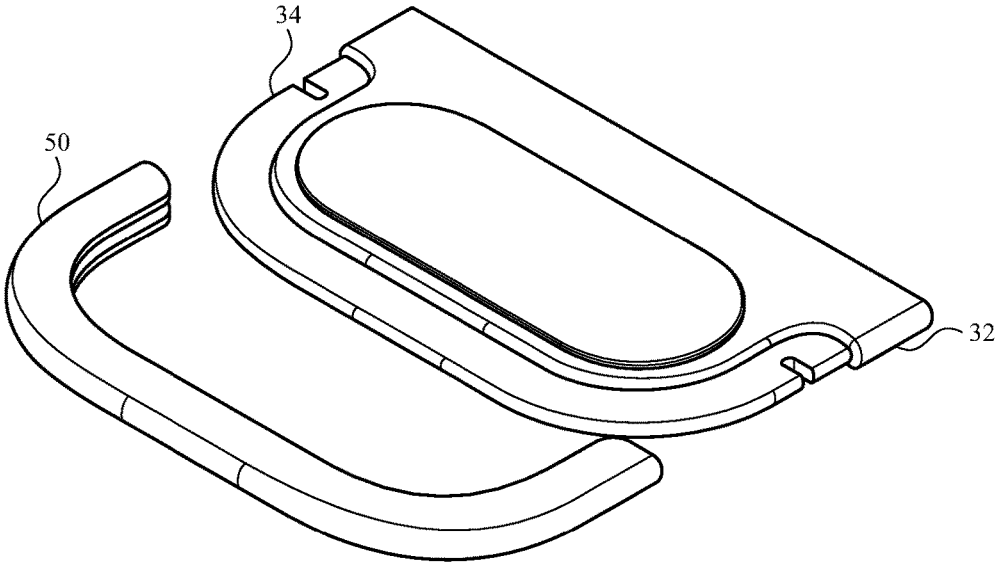
FIG. 13 is a perspective exploded view of a stopper and a base, in accordance with some embodiments of the present disclosure.

According to some embodiments, for example as shown in FIGS. 11-13, the stopper 50 is molded onto the base 32. The stopper 50 can include one or more protrusions 198 that provide a cross-sectional dimension that is greater than a hole 42 of the retaining ring 40. The base 32 can include an engagement section 34 with which one or more portions of the stopper 50 can engage. As shown in FIG. 12, the engagement section 34 can include holes. As shown in FIG. 13, the engagement section 34 can include notches. The stopper 50 can be overmolded onto the engagement section 34 of the base 32, such that a portion of the stopper 50 extends into voids of the engagement section 34 for secure engagement thereof.

Figure 14:
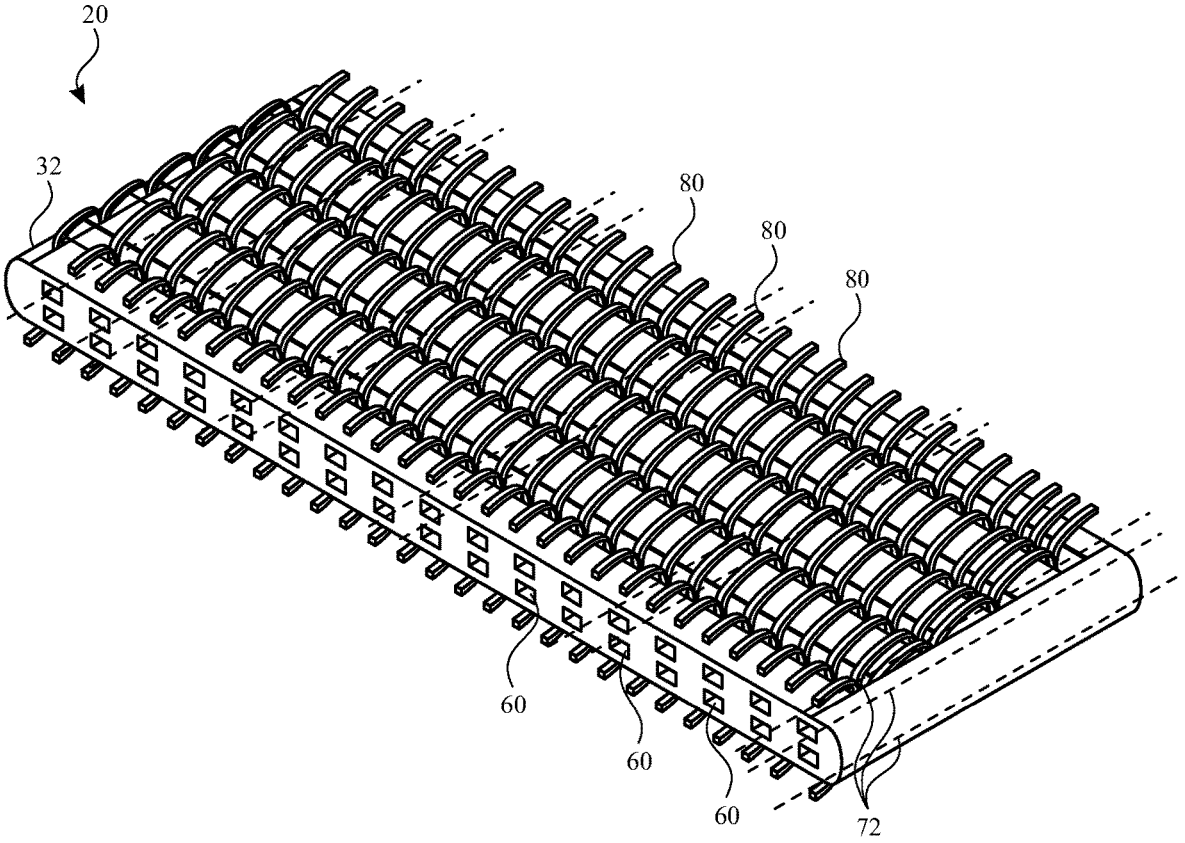
FIG. 14 is a perspective sectional view of a portion of a watchband, in accordance with some embodiments of the present disclosure.

According to some embodiments, for example as shown in FIG. 14, the watchband 20 includes loops 80 above the base 32. The loops 80 can be formed by loop threads that extend from and return to the base 32. Each of the loop threads can be woven into the base 32 and extend onto or beyond the contact surface 26 and the engagement surface 28. The base 32 can be formed from base threads 60 and/or elastic threads 72. The elastic threads 72 extend longitudinally, for example toward the housing connector 30 and the stopper 50. The base threads 60 extend transverse to the elastic threads 72 and/or the loop threads. The elastic threads 72 turn and reverse direction at one or more ends of the base 32.

As used herein, a loop is defined by a length of a structure that surrounds a closed space. A loop can be formed by a thread even when the thread does not connect to itself to surround the closed space. For example, a "loop" of thread can extend from a base and return to the base, such that the thread and the base together surround a closed space.

Materials selected for the threads can be selected to facilitate the manufacture and use described herein. The threads can include natural and/or synthetic fibers. The threads can include a polymer, copolymer, or polymer blend. The threads can include nylon, polyester, polyurethane, and combinations thereof, including spandex. The threads can include single filaments and/or a bundle of yarn. The elastic threads 72 can be of a material that facilitates stretching. The base threads 60 and the loop threads can be of the same or a similar material. The base threads 60 can have a melting point that is lower than a melting point of the loop threads.

Figure 15:
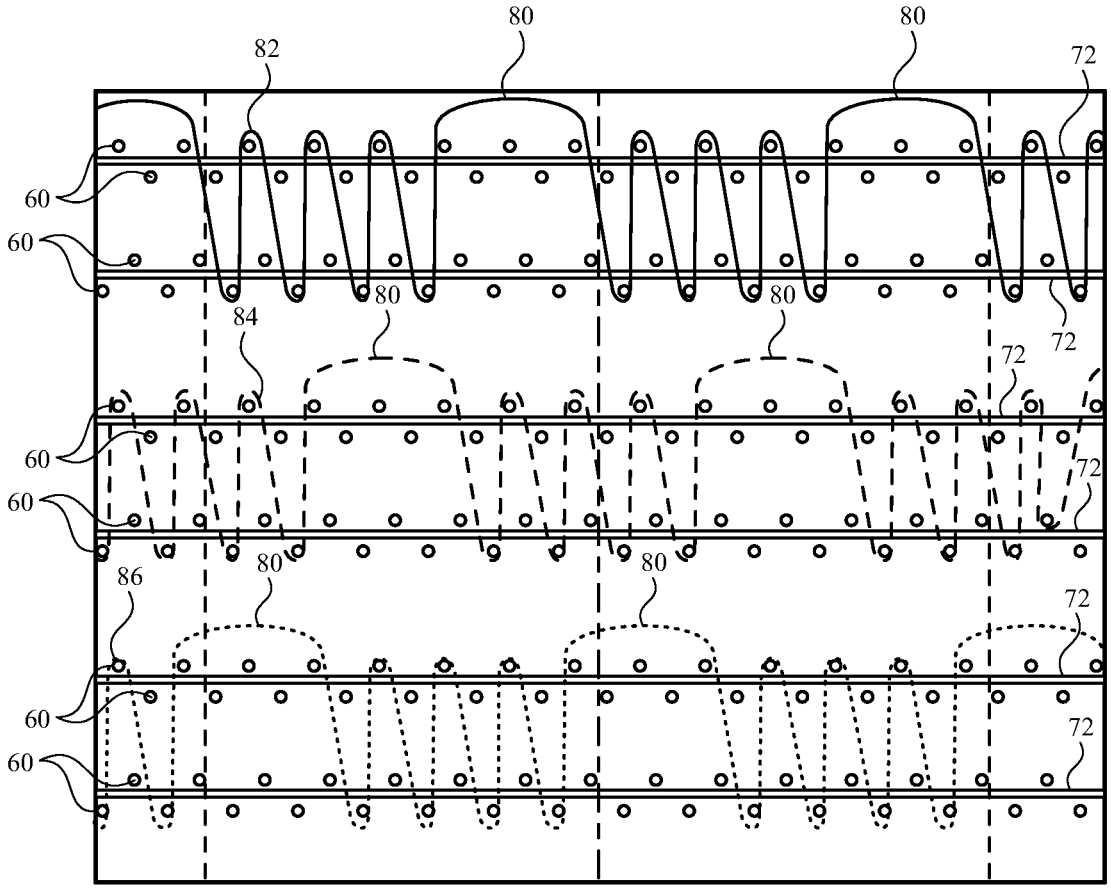
FIG. 15 is a sectional view showing a weave pattern, in accordance with some embodiments of the present disclosure.

According to some embodiments, for example as shown in FIG. 15, one or more engagement loop threads are used to form engagement loops 80 on the engagement surface 28. The engagement loops 80 are formed and arranged to enhance engagement with hooks. For example, the shape, size, number, and distribution of the engagement loops 80 can facilitate ready and secure engagement with hooks. Such features are provided with a weave by which the engagement loops 80 are formed.

As shown in FIG. 15, first engagement loop threads 82, second engagement loop threads 84, and third engagement loop threads 86 are woven into the same base 32. The first engagement loop threads 82, the second engagement loop threads 84, and the third engagement loop threads 86 are separate threads or segments of one or more continuous threads. At least some segments of the engagement loop threads, including the engagement loops 80, extend in parallel to each other along the base 32.

As shown in FIG. 15, a first engagement loop thread 82 forms an engagement loop 80 extending away from the engagement surface 28 of the base 32 and along a longitudinal length. The longitudinal length of the engagement loop 80 corresponds to a number of base threads 60 between the locations at which the engagement loop 80 extends from the base 32. For example, as shown in FIG. 15, the engagement loops 80 extend longitudinally across five base threads 60 (i.e., referring to a combined number of base threads 60 on opposite surfaces of the base 32). Other longitudinal lengths and numbers of skipped base threads 60 can apply to characterize the engagement loop 80, as described further herein. For example, an engagement loop thread can form an engagement loop 80 that extends across 3, 4, 5, 6, 7, 8, 9, 10, or more than 10 base threads 60.

Between each engagement loop 80, the first engagement loop thread 82 extends alternatingly between and/or beyond opposing surfaces (i.e., the contact surface 26 and the engagement surface 28) of the base 32. At each of the surfaces, the first engagement loop thread 82 extends at least partially about a base thread 60 and turn to reenter the base 32. The first engagement loop thread 82 turns and returns to the base 32 without forming an engagement loop 80 or extending longitudinally in a manner that skips any base threads 60. In such an arrangement, the turn of the first engagement loop thread 82 is against the base 32, rather than elevated away from the base 32 as an engagement loop 80. The extent of the first engagement loop thread 82 between adjacent engagement loops 80 corresponds to a number of consecutive base threads 60 about which the first engagement loop thread 82 turns. For example, as shown in FIG. 15, the first engagement loop thread 82 can turn about seven consecutive base threads 60 between adjacent engagement loops 80. Other numbers of contacted base threads 60 can apply to characterize the first engagement loop thread 82, as described further herein. For example, an engagement loop thread can turn about 2, 3, 4, 5, 6, 7, 8, 9, 10, 11, 12, 13, 14, or more than 14 consecutive base threads 60 between adjacent engagement loops 80.

As shown in FIG. 15, different threads are staggered, such that the engagement loops 80 of one thread are formed at different longitudinal locations than the engagement loops 80 of another thread. For example, engagement loops 80 of the first engagement loop thread 82 can be formed at a longitudinal location that is different from the location of the engagement loops 80 formed by the second engagement loop thread 84. Furthermore, engagement loops 80 of the third engagement loop thread 86 can be formed at a longitudinal location that is different from the location of the engagement loops 80 formed by the first engagement loop thread 82 and the location of the engagement loops 80 formed by the second engagement loop thread 84. Such an arrangement allows the engagement loops 80 to be distributed farther away from each other, so that greater opportunities for engagement with hooks are provided. Accordingly, the engagement loops 80 of one thread extend across a set of base threads 60 that is different than the set of base threads 60 across which engagement loops 80 of another thread extend. Additionally, the engagement loops 80 of one thread turn about a set of consecutive base threads 60 that is different than the set of consecutive base threads 60 about which another thread turns.

Figure 16:
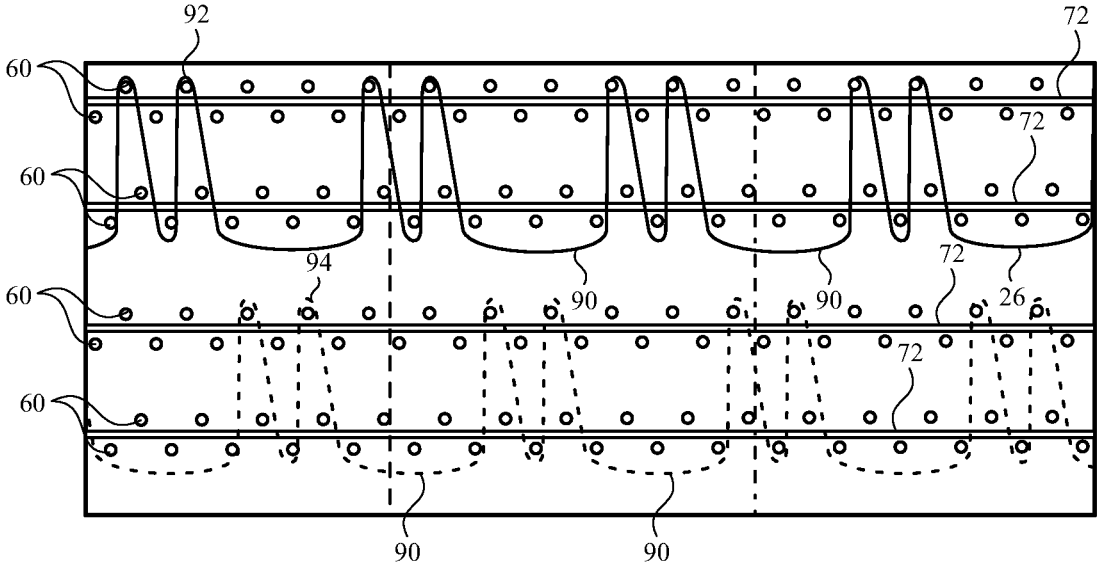
FIG. 16 is a sectional view showing a weave pattern, in accordance with some embodiments of the present disclosure.

According to some embodiments, for example as shown in FIG. 16, one or more contact loop threads are used to form contact loops 90 on the contact surface 26. The contact loops 90 are formed and arranged to enhance contact with the wrist 2 of the user. For example, the shape, size, number, and distribution of the contact loops 90 facilitate comfort, breathability, and moisture wicking capabilities for the user. Such features can be provided with a weave by which the contact loops 90 are formed.

As shown in FIG. 16, first contact loop threads 92 and second contact loop threads 94 can be woven into the same base 32. The first contact loop threads 92 and the second contact loop threads 94 can be separate threads or segments of one or more continuous threads. At least some segments of the contact loop threads, including the contact loops 90, extend in parallel to each other along the base 32.

As shown in FIG. 16, a first contact loop thread 92 forms a contact loop 90 extending away from the contact surface 26 of the base 32 and along a longitudinal length. The longitudinal length of the contact loop 90 corresponds to a number of base threads 60 between the locations at which the contact loop 90 extends from the base 32. For example, as shown in FIG. 15, the contact loops 90 extend longitudinally across five base threads 60 (i.e., referring to a combined number of base threads 60 on opposite surfaces of the base 32). Other longitudinal lengths and numbers of skipped base threads 60 can apply to characterize the contact loop 90, as described further herein. For example, a contact loop thread can form a contact loop 90 that extends across 3, 4, 5, 6, 7, 8, 9, 10, or more than 10 base threads 60.

The longitudinal length of one or more of the engagement loops 80 can be the same or different than the longitudinal length of one or more of the contact loops 90. For example, the lengths can be uniform for both the engagement loops 80 on the engagement surface 28 and the contact loops 90 on the contact surface 26. Alternatively or in combination, the loops can have different sizes to accommodate the different functions of contacting the user and engaging hooks.

Between each contact loop 90, the first contact loop thread 92 extends alternatingly between and/or beyond opposing surfaces (i.e., the contact surface 26 and the engagement surface 28) of the base 32. At each of the surfaces, the first contact loop thread 92 extends at least partially about a base thread 60 and turn to reenter the base 32. The first contact loop thread 92 turns and returns to the base 32 without forming a contact loop 90 or extending longitudinally in a manner that skips any base threads 60. In such an arrangement, the turn of the first contact loop thread 92 is against the base 32, rather than elevated away from the base 32 as a contact loop 90. The extent of the first contact loop thread 92 between adjacent contact loops 90 corresponds to a number of consecutive base threads 60 about which the first contact loop thread 92 turns. For example, as shown in FIG. 16, the first contact loop thread 92 turn about 3 consecutive base threads 60 between adjacent contact loops 90. Other numbers of contacted base threads 60 can apply to characterize the first contact loop thread 92, as described further herein. For example, a contact loop thread can turn about 2, 3, 4, 5, 6, 7, 8, or more than 8 consecutive base threads 60 between adjacent engagement loops 80.

The number of turns between adjacent engagement loops 80 can be the same or different than the number of turns between adjacent contact loops 90. For example, the number of turns can be different to accommodate the different functions of contacting the user and engaging hooks. The number of turns between adjacent engagement loops 80 can be greater than the number of turns between adjacent contact loops 90, so that the engagement loops 80 remain more securely fixed throughout multiple hook engagement and disengagement actions. A lower number of turns between adjacent contact loops 90 can also yield a greater density of contact loops 90 in a given area of the base 32. For example, where the engagement loops 80 and the contact loops 90 have the same or substantially equal lengths, the lower number of turns between adjacent contact loops 90 produces a greater number of contact loops 90 than engagement loops 80 in a given area. The higher density of contact loops 90 provides greater comfort for the user by distributing forces across the greater number of contact loops 90.

As shown in FIG. 16, different threads can be staggered, such that the contact loops 90 of one thread are formed at different longitudinal locations than the contact loops 90 of another thread. For example, contact loops 90 of the first contact loop thread 92 can be formed at a longitudinal location that is different from the location of the contact loops 90 formed by the second contact loop thread 94. Such an arrangement allows the contact loops 90 to be distributed farther away from each other, so that forces and pressure on the wrist 2 of the user is more evenly distributed. Accordingly, one thread can extend across a set of base threads 60 that is different than the set of base threads 60 across which contact loops 90 of another thread extend. Additionally, one thread can turn about a set of consecutive base threads 60 that is different than the set of consecutive base threads 60 about which another thread turns.

One or more of the engagement loops 80 and one or more of the contact loops 90 can be segments of a continuous thread. For example, a single thread can extend through the base 32 to form loops on both the engagement surface 28 and the contact surface 26. By further example, a single thread can form engagement loops 80 on the engagement surface 28 between ends of the base 32, turn to reverse direction, and form contact loops 90 on the contact surface 26 between the ends of the base.

According to some embodiments, the engagement loops 80 and the contact loops 90 are formed and secured by a weaving process. The base 32 can be stretched longitudinally to increase the longitudinal spacing between the base threads 60. The elastic threads 72, extending longitudinally, can facilitate the stretching based on elastic properties of the elastic threads 72. The loop threads can be woven into the base 32 as described herein while the base 32 is in the stretched configuration. When the base 32 returns to a non-stretched or relaxed configuration, the engagement loops 80 and the contact loops 90 become elevated from the base 32 due to the shortening between the locations at which the engagement loops 80 and the contact loops 90 extend from the base 32. The loop threads and the base 32 can be heated, such that at least the base threads 60 at least partially melt to fuse and bond to the loop threads that contact and turn about the base threads 60. Thus, a secure engagement between the loop threads and the base threads 60 is achieved. The strength of the bond can be proportionate to the number of turns made by the loop threads about the base threads 60.

The watchband can be made in a variety of colors with visual effects that occur based on the design described herein. At least some of the contact loop threads, the engagement loop threads, the contact base threads, and the engagement base threads can be of different colors that other threads in the watchband 20. The several threads can be combined to produce custom color combinations as desired. The colors can be selected based on the appearance of certain threads in the weaving patterns described herein. Furthermore, because portions of the threads are elevated away from a surface, the weaving pattern produces different visual effects when viewed at different angles. For example, at some viewing angles, rows of the loops present themselves visually while blocking views of many of the base threads. At these angles, the color selected for the loop threads is relatively more prominent. At other viewing angles, the base threads are viewed more easily. At these angles, the color selected for the base threads is relatively more prominent. As such, the apparent color, pattern, and design changes as the watchband 20 is viewed from different angles.

Figure 17:
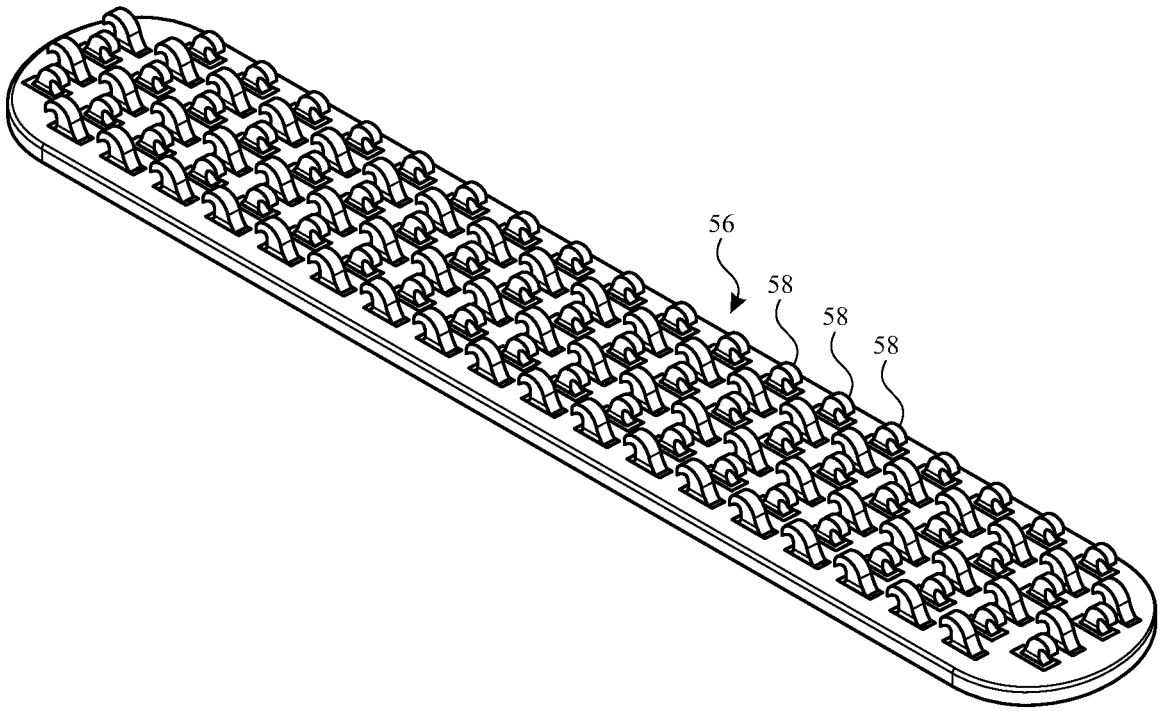
FIG. 17 is a perspective view of a hook pad, in accordance with some embodiments of the present disclosure.

According to some embodiments, for example as shown in FIG. 17, a hook pad 56 can include one or more hooks 58 for engagement with loops. The hooks 58 can be distributed across a surface of the hook pad 56. The number, density, size, and/or shape of the hooks 58 can be consistent or vary across the surface of the hook pad 56. The perimeter of the hook pad 56 can include one or more curves to reduce sharpness of the edges.

Figure 18:
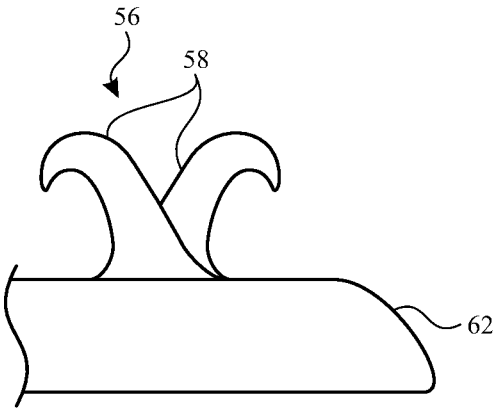
FIG. 18 is a side view of a hook pad, in accordance with some embodiments of the present disclosure.

According to some embodiments, for example as shown in FIG. 18, a hook pad 56 includes a transition from a top surface to a bottom surface that reduces sharp edges. For example, the hook pad 56 can include an edge region 62 along a periphery of the hook pad 56. The edge region 62 can include one or surface features that provide a transition. For example as shown in FIG. 18, the hook pad 56 can include a round bevel. Other shapes and geometries can be provided. For example, the edge region 62 can include one or more chamfers, fillets, scallops, undulations, and/or textures. The edge region 62 reduces sharpness relative to a right angle corner or edge. The transition provided by the edge region 62 provides comfort upon contact with the user and avoid catching on objects. According to some embodiments, the hook pad 56 is formed from a sheet that includes hooks 58. The hook pad 56 can be cut from the sheet, for example with a die cut. The edge region 62 can be formed by cutting or molding regions of the hook pad 56 to have the desired shape.

The number, density, size, and/or shape of the hook pads 56 can be consistent or vary across the surface of the hook zone 54. The hook pads 56 can be attached to the base 32 by one or more of welding (e.g., laser welding), lamination, adhesion, interweaving, or combinations thereof.

Figure 19:
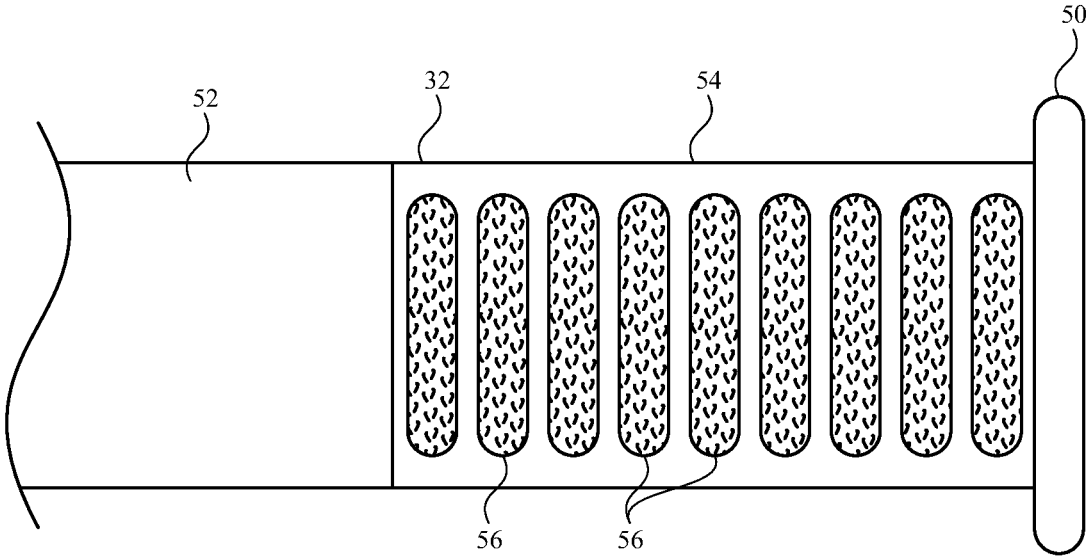
FIG. 19 is a top view of a portion of a watchband, in accordance with some embodiments of the present disclosure.
Figure 20:
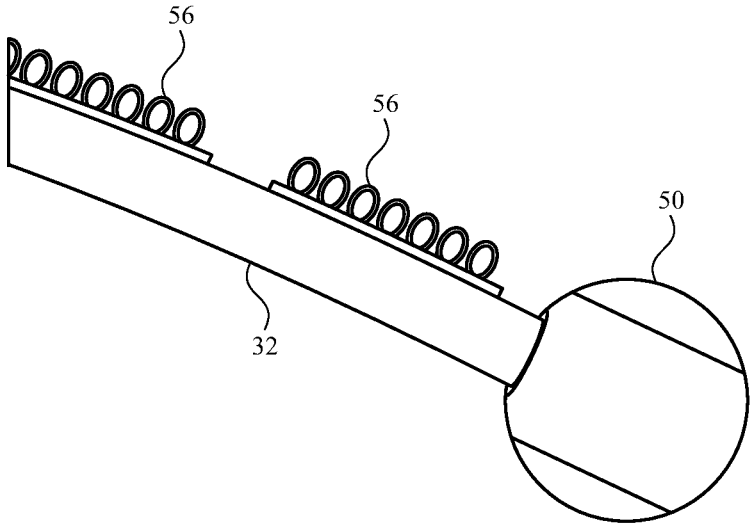
FIG. 20 is a side view of the portion of the watchband of FIG. 19, in accordance with some embodiments of the present disclosure.

According to some embodiments, for example as shown in FIGS. 19 and 20, multiple hook pads 56 are provided along a hook zone 54 of a watchband 20. The hook zone 54 is adjacent to a loop zone 52 of the watchband 20. The hook zone 54 provides a length of the base 32 without loops extending therefrom. The hook zone 54 can be adjacent to the stopper 50. Each of the hook pads 56 is longitudinally spaced apart from one or longitudinally adjacent hook pads 56. The interruptions between hook pads 56 provide greater flexibility than would be provided with a continuous length of one or more hook pads 56. Accordingly, the hook zone 54 has an overall greater flexibility with the interruptions. One or more hook pads 56 at or near a terminal end of the watchband 20 can provide enhanced engagement. For example, an endmost one of the hook pads 56 can be larger than other hook pads 56 located within the hook zone 54 at greater distances from the stopper 50. Other features can be provided, such as a different number, density, distribution, size, and/or shape of hooks on one or more hook pads 56 at or near a terminal end of the watchband 20 as compared to the other hook pads 56. The distinct features of the endmost hook pad 56 can provide stronger engagement near the terminal end of the watchband 20 to resist forces that would disengage the watchband 20 from itself. A greater number of hook pads 56 with small interruptions can also provide flexibility, with a greater surface area of the hook zone 54 being occupied by hook pads 56.

Figure 21:
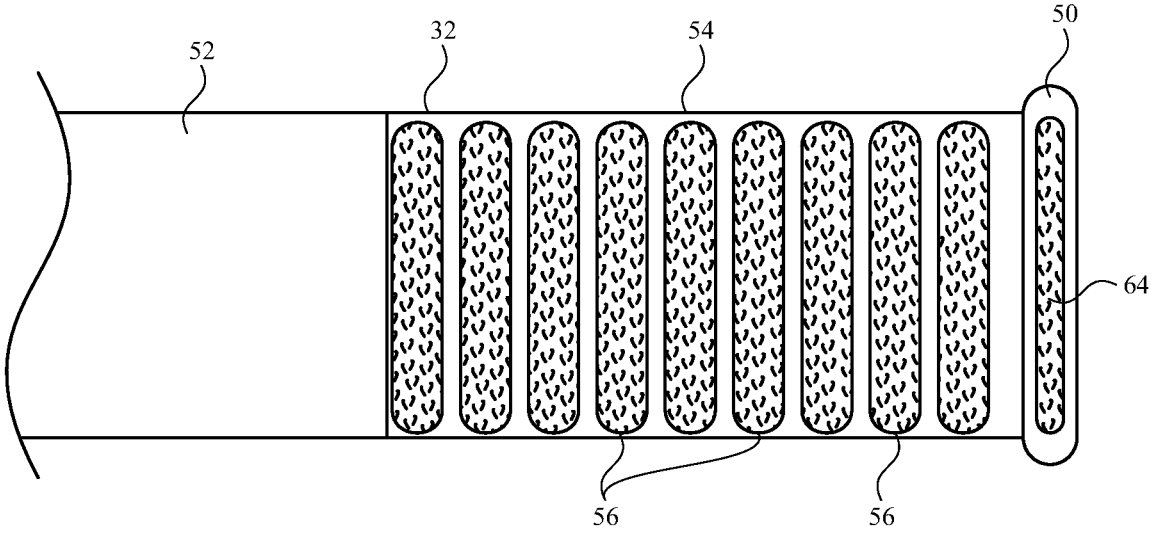
FIG. 21 is a top view of a portion of a watchband, in accordance with some embodiments of the present disclosure.
Figure 22:
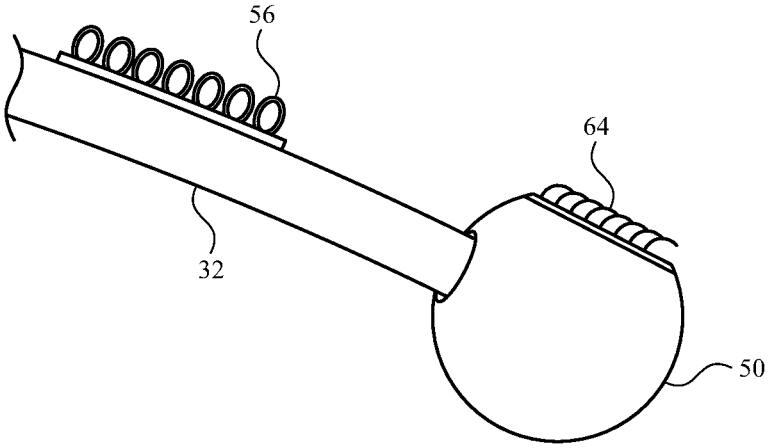
FIG. 22 is a side view of the portion of the watchband of FIG. 21, in accordance with some embodiments of the present disclosure.

According to some embodiments, for example as shown in FIGS. 21 and 22, the stopper 50 includes an engagement element 64. Alternatively to or in combination with the hook pads 56 on the base 32 along the hook zone 54, the engagement element 64 of the stopper 50 can include hooks or another feature for engaging another portion of the watchband 20. The engagement element 64 can be attached to the stopper 50 by one or more of welding (e.g., laser welding), lamination, adhesion, interweaving, or combinations thereof. Hooks of the engagement element 64 can engage to loops of the loop zone 52. The engagement element 64 of the stopper 50 can be larger than hook pads 56 located within the hook zone 54. Other features can be provided, such as a different number, density, distribution, size, and/or shape of hooks on the engagement element 64 as compared to the hook pads 56. The distinct features of the engagement element 64 provide stronger engagement for the stopper 50 to resist forces that would otherwise disengage the stopper 50 from engagement with other portions of the watchband 20. Alternatively or in combination, the engagement element 64 can include a magnet, a clasp, or another mechanism to releasably engage another portion of the watchband 20. The engagement element 64 of the stopper 50 advantageously provides engagement near the terminal end of the watchband 20. This arrangement helps facilitate engagement along a greater extent of the watchband 20. Furthermore, forces acting on the stopper 50 are resisted to keep the stopper 50 engaged with other portions of the watchband 20.

Figure 23:
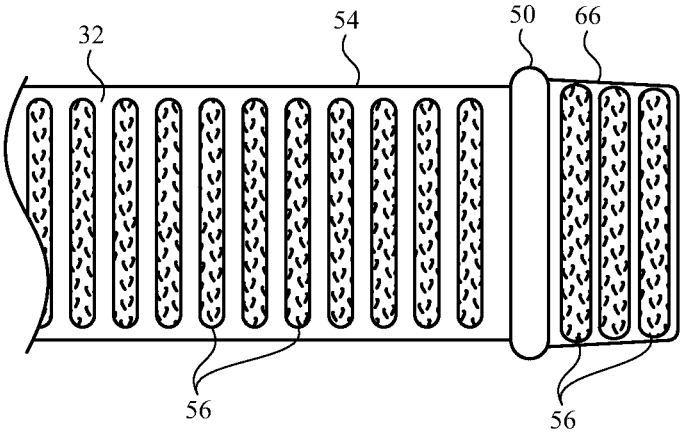
FIG. 23 is a perspective view of a portion of a watchband, in accordance with some embodiments of the present disclosure.

According to some embodiments, for example as shown in FIG. 23, a hook section 66 is positioned at or near a terminal end of the watchband 20. The stopper 50 can be positioned between the hook zone 54 and the hook section 66. Both the hook zone 54 and the hook section 66 can include one or more hook pads 56. Accordingly, the hooks on both the hook zone 54 and the hook section 66 provide engagement with other portions of the watchband 20 (e.g., loops). The hook section 66 advantageously provides engagement near the terminal end of the watchband 20 to resist forces that would disengage the watchband 20 from itself.

Figure 24:
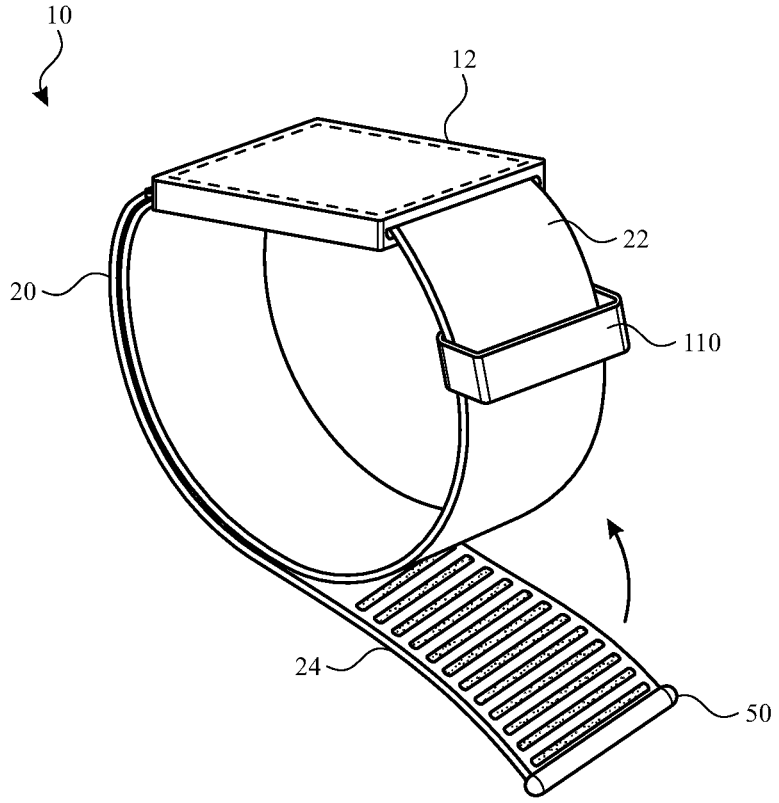
FIG. 24 is a perspective view of a watch, in accordance with some embodiments of the present disclosure.
Figure 25:
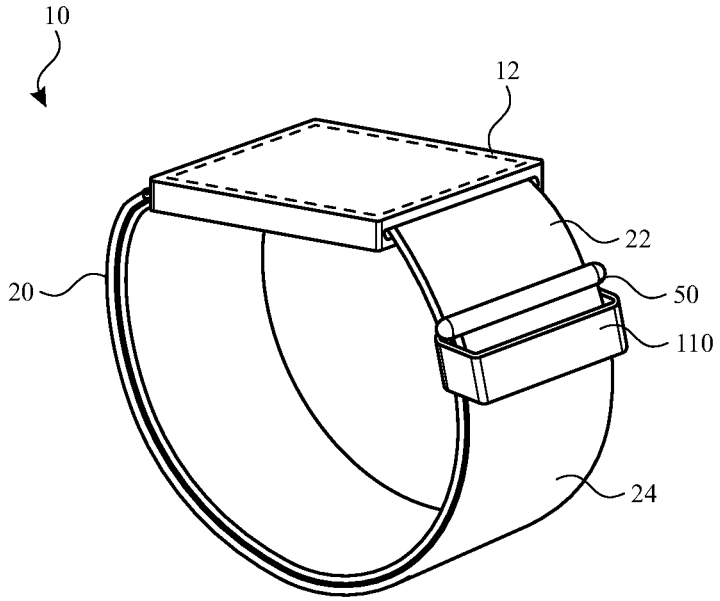
FIG. 25 is a perspective view of the watch of FIG. 24, in accordance with some embodiments of the present disclosure.
Figure 26:
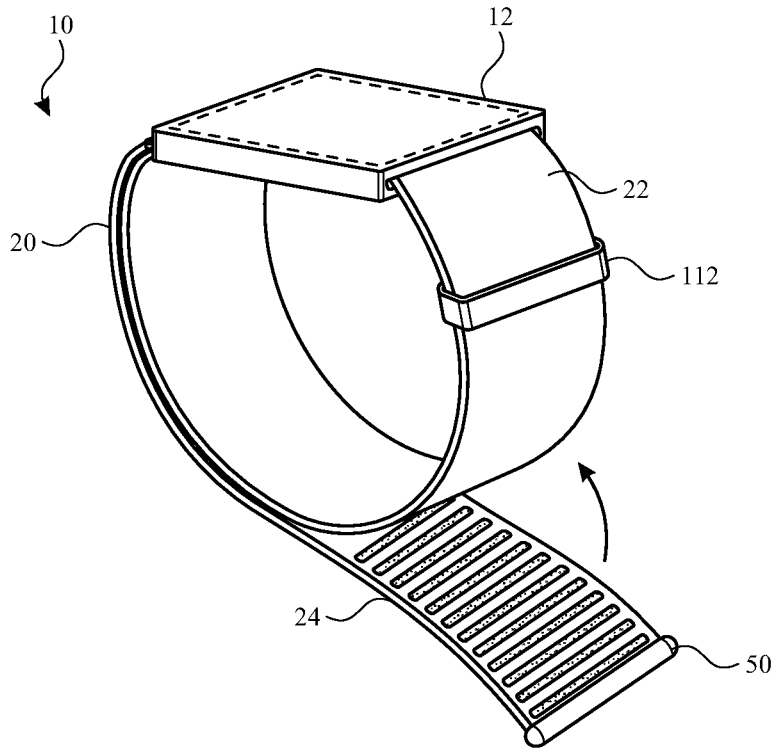
FIG. 26 is a perspective view of a watch, in accordance with some embodiments of the present disclosure.

According to some embodiments, for example as shown in FIGS. 24 and 25, a capture band 110 retains the stopper 50 when inserted therein. The capture band 110 stretches and/or deforms elastically to receive the stopper 50 and/or the outer portion 24 of the watchband 20. As shown in FIGS. 24 and 25, a user can insert at least the stopper 50 through a portion of the capture band 110. The capture band 110 then encompasses a portion of the inner portion 22 and the outer portion 24. In such an arrangement, the capture band 110 provides additional support to keep the outer portion 24 engaged with and/or in contact with the inner portion 22. The capture band 110 is slideable along a longitudinal length of the inner portion 22 and/or the outer portion 24. For example, the capture band 110 can receive the stopper 50 and be adjusted to be near the stopper 50. The capture band 110 is resilient and sized to press the outer portion 24 and the inner portion 22 together. The user can remove the stopper 50 and the outer portion 24 from the capture band 110 by sliding the capture band 110 relative to the outer portion 24 and the stopper 50.

Figure 27:
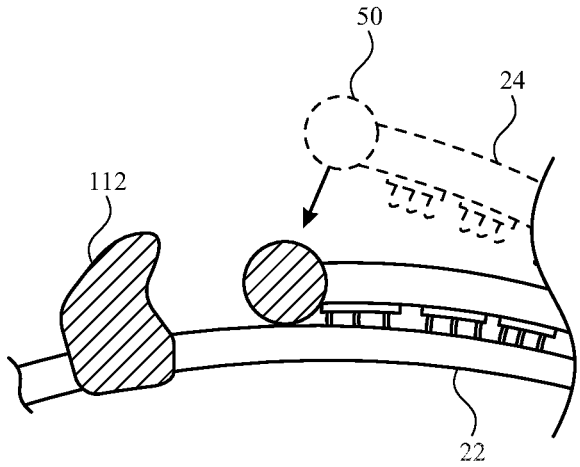
FIG. 27 is a side sectional view of a portion of the watch of FIG. 26, in accordance with some embodiments of the present disclosure.
Figure 28:
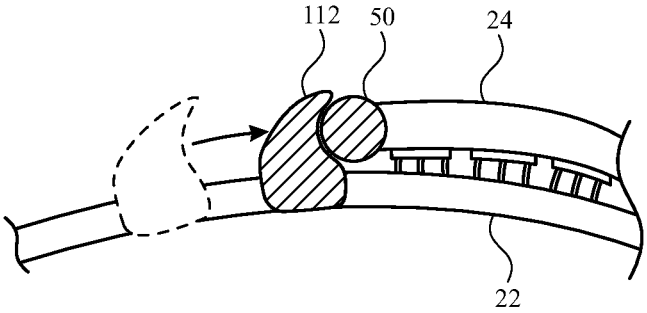
FIG. 28 is a side sectional view of a portion of the watch of FIG. 28, in accordance with some embodiments of the present disclosure.

According to some embodiments, for example as shown in FIGS. 26-45, a slideable shield 112 retains the stopper 50 when connected thereto. The slideable shield 112 is adjustable to be aligned with the stopper 50. For example, as shown in FIG. 27, a user can apply the outer portion 24 to the inner portion 22, bringing the stopper 50 into close proximity with the inner portion 22. As shown in FIG. 28, the slideable shield 112 is slideable along the inner portion 22 to be aligned with the stopper 50. The slideable shield 112 can be in contact with the stopper 50 and/or extend over at least a portion of the stopper 50. In such an arrangement, the slideable shield 112 provides additional support to keep the stopper 50 engaged with and/or in contact with the inner portion 22. Forces that would otherwise pull the stopper away from the inner portion 22 are deflected by the shielding provided by the slideable shield 112. For example, the stopper 50 and the slideable shield 112 can include a mechanism (e.g., magnets, hook and loop, clasp) that facilitates engagement between the stopper 50 and the slideable shield 112. The user can remove the stopper 50 from the slideable shield 112 by sliding the slideable shield 112 and the stopper 50 away from each other.

Figure 29:
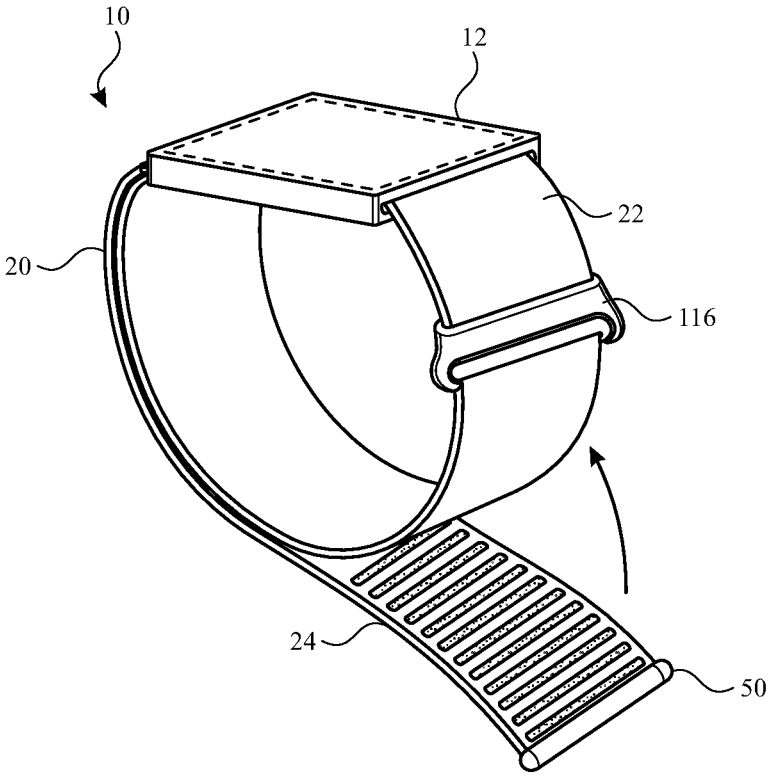
FIG. 29 is a perspective view of a watch, in accordance with some embodiments of the present disclosure.

According to some embodiments, for example as shown in FIG. 29, a slideable receptacle 116 retains the stopper 50 when connected thereto. The slideable receptacle 116 is adjustable to be aligned with the stopper 50. For example, as shown in FIG. 29, a user can apply the outer portion 24 to the inner portion 22, bringing the stopper 50 into close proximity with the inner portion 22. The slideable receptacle 116 is slideable along the inner portion 22 to be aligned with the stopper 50. The slideable receptacle 116 and the stopper 50 can have complementary shapes, so that the stopper 50 fits tightly within the slideable receptacle 116 when pressed therein. For example, the stopper 50 can be slightly oversized with respect to the slideable receptacle 116. Alternatively or in combination, the slideable receptacle 116 and the stopper 50 can have complementary features, such as a button coupling including a socket and a stud, so that the stopper 50 can snap into place with the slideable receptacle 116 when pressed together. When engaged, the slideable receptacle 116 provides support to keep the stopper 50 engaged therein. The user can remove the stopper 50 from the slideable receptacle 116 by applying a force sufficient to overcome the engagement.

Figure 30:
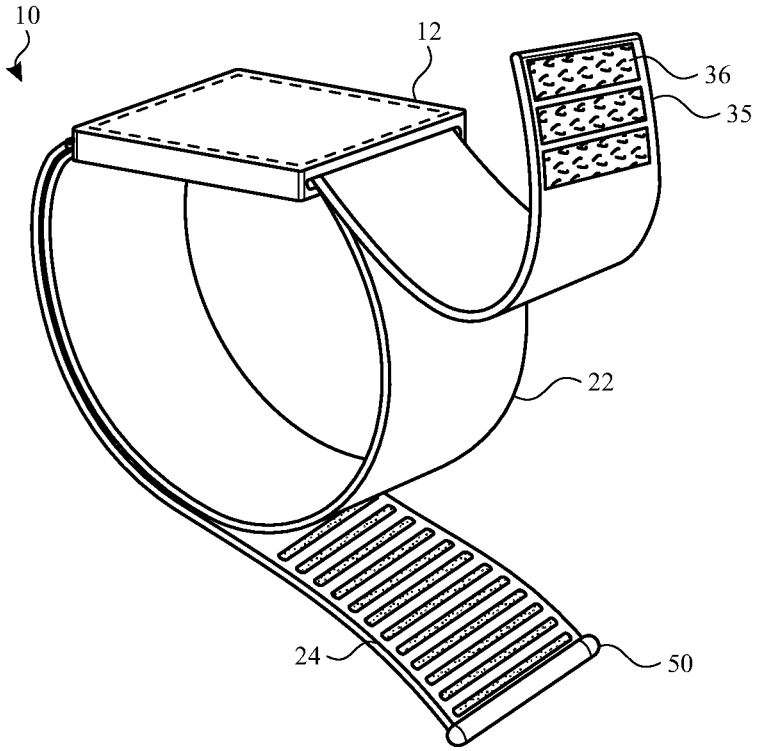
FIG. 30 is a perspective view of a watch, in accordance with some embodiments of the present disclosure.
Figure 31:
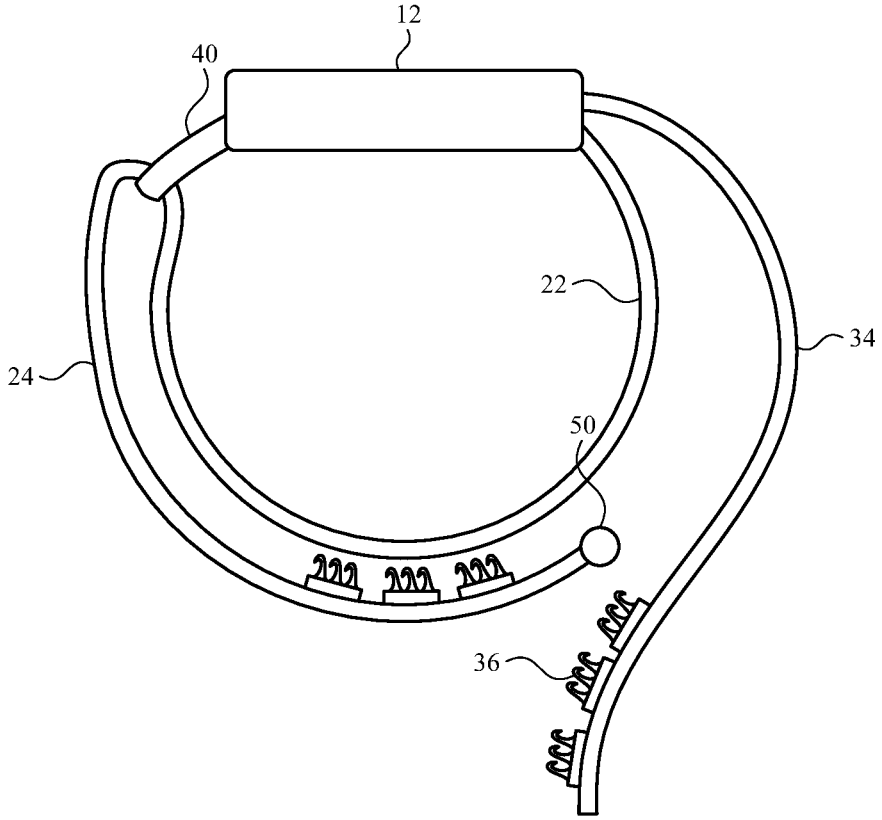
FIG. 31 is a side view of the watch of FIG. 30, in accordance with some embodiments of the present disclosure.
Figure 32:
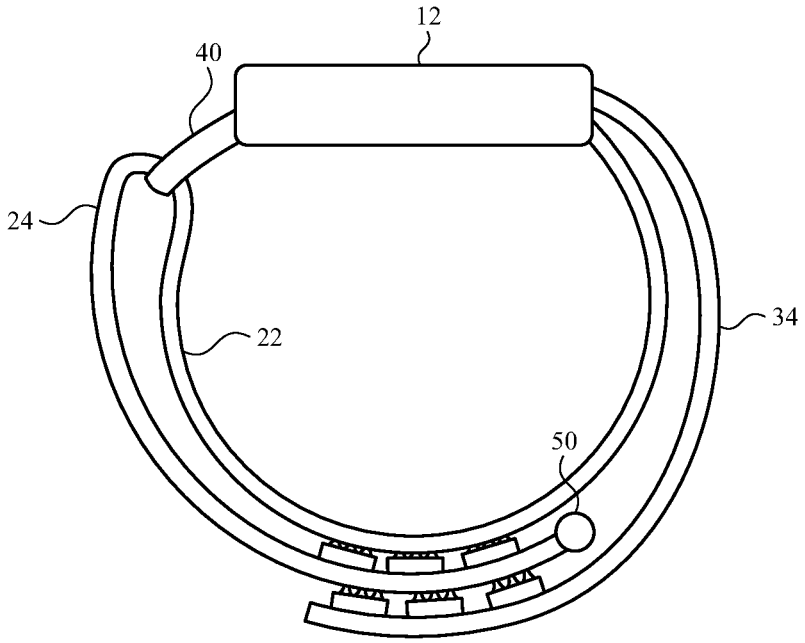
FIG. 32 is a side view of the watch of FIG. 30, in accordance with some embodiments of the present disclosure.

According to some embodiments, for example as shown in FIGS. 30-32, a cover strap 35 retains the stopper 50 and the outer portion 24 against the inner portion 22. The cover strap 35 extends from the housing 16 of the electronic device 12, the housing connector 30, another structure opposite the retaining ring 40, and/or another portion of the watchband 20. The cover strap 35 can include hook pads 36 for engaging loops of the outer portion 24. For example, as shown in FIG. 31, a user can apply the outer portion 24 to the inner portion 22, bringing the stopper 50 into close proximity with the inner portion 22. As shown in FIG. 32, the cover strap 35 is applied to an outer surface of the outer portion 24. The cover strap 35 can extend over the stopper 50 and at least a portion of the outer portion 24. The hook pads 36 of the cover strap 35 can engage loops on an outer surface of the outer portion 24. In such an arrangement, the cover strap 35 provides additional support to keep the stopper 50 engaged with and/or in contact with the inner portion 22. Forces that would otherwise pull the stopper away from the inner portion 22 are deflected by the shielding provided by the cover strap 35. Furthermore, forces that would tend to pull the cover strap 35 away from the outer portion 24 would tend not to pull the stopper 50 away from the inner portion 22. The user can remove the cover strap 35 from the outer portion 24 by pulling the sufficient force to disengage the hook pads 36 from the loops on the outer surface of the outer portion 24.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A watchband comprising:

a base comprising base threads and having a first surface opposite a second surface;

a first thread woven about the base threads between the first surface and the second surface and forming first loops on the first surface; and a second thread woven about the base threads between the first surface and the second surface and forming second loops on the second surface, wherein, between adjacent second loops, the second thread is secured about a greater number of the base threads than is the first thread between adjacent first loops.

2. The watchband of claim 1, wherein the base threads are transverse to the first thread and the second thread.

3. The watchband of claim 1, wherein the base threads form two plies of fabric, each of the plies having an elastic thread extending transverse to the base threads.

4. The watchband of claim 1, wherein a density of the first loops on the first surface is greater than a density of the second loops on the second surface.

5. The watchband of claim 1, wherein the first thread and the second thread are fused to the base threads.

6. The watchband of claim 1, wherein the first thread and the second thread are segments of a continuous strand.

7. The watchband of claim 1, further comprising:

a third thread woven about the base threads between the first surface and the second surface and forming third loops on the first surface, wherein the first loops extend over the first surface at different longitudinal locations than do the third loops; and a fourth thread woven about the base threads between the first surface and the second surface and forming fourth loops on the second surface, wherein the second loops extend over the second surface at different longitudinal locations than do the fourth loops.

8. A watchband comprising:

a base comprising base threads and having a first surface opposite a second surface;

a first thread woven about the base threads between the first surface and the second surface and forming first loops on the first surface; and a second thread woven about the base threads between the first surface and the second surface and forming second loops on the second surface, wherein a distance between any given pair of adjacent second loops is greater than a distance between any given pair of adjacent first loops.

9. The watchband of claim 8, wherein the base threads are transverse to the first thread and the second thread.

10. The watchband of claim 8, wherein the base threads form two plies of fabric, each of the plies having an elastic thread extending transverse to the base threads.

11. The watchband of claim 8, wherein a density of the first loops on the first surface is greater than a density of the second loops on the second surface.

12. The watchband of claim 8, wherein the first thread and the second thread are fused to the base threads.

13. The watchband of claim 8, wherein the first thread and the second thread are segments of a continuous strand.

14. The watchband of claim 8, further comprising:

a third thread woven about the base threads between the first surface and the second surface and forming third loops on the first surface, wherein the first loops extend over the first surface at different longitudinal locations than do the third loops; and a fourth thread woven about the base threads between the first surface and the second surface and forming fourth loops on the second surface, wherein the second loops extend over the second surface at different longitudinal locations than do the fourth loops.

15. A watchband comprising:

a base comprising base threads and having a first surface opposite a second surface;

a first thread woven about the base threads between the first surface and the second surface and forming first loops on the first surface; and a second thread woven about the base threads between the first surface and the second surface and forming second loops on the second surface, wherein, along a length of the base, a total number of the first loops on the first surface is greater than a total number of the second loops on the second surface.

16. The watchband of claim 15, wherein the base threads are transverse to the first thread and the second thread.

17. The watchband of claim 15, wherein the base threads form two plies of fabric, each of the plies having an elastic thread extending transverse to the base threads.

18. The watchband of claim 15, wherein a density of the first loops on the first surface is greater than a density of the second loops on the second surface.

19. The watchband of claim 15, wherein the first thread and the second thread are fused to the base threads.

20. The watchband of claim 15, wherein the first thread and the second thread are segments of a continuous strand.

* * * * *